US005318731A

United States Patent [19]

Yokoya et al.

[11] Patent Number: 5,318,731

[45] Date of Patent: Jun. 7, 1994

[54] HUMIDIFIER

[75] Inventors: Hisao Yokoya; Kenzo Takahashi; Shigeo Makimura, all of Gifu, Japan

[73] Assignee: Mitsubishi Denki Kabushiki Kaisha, Tokyo, Japan

[21] Appl. No.: 77,601

[22] Filed: Jun. 17, 1993

[30] Foreign Application Priority Data

Jul. 29, 1992 [JP] Japan ..... 4-202476

[51] Int. Cl.[5] ..... B01F 3/04

[52] U.S. Cl. ..... 261/104; 261/101

[58] Field of Search ..... 261/104, 101, 95

[56] References Cited

U.S. PATENT DOCUMENTS 3,045,450 7/1962 Chandler ..... 261/104
3,954,920 5/1976 Heath ..... 261/104
4,618,462 10/1986 Fisher ..... 261/104
4,758,385 7/1988 Acker et al. ..... 261/104
4,774,032 9/1988 Coates ..... 261/104

FOREIGN PATENT DOCUMENTS 0240046 10/1986 Japan ..... 261/104

*Primary Examiner*—Tim Miles

[57] ABSTRACT

In a humidifier, its humidifier body is formed as follows: A plurality of ribs 3 made of a flexible material are fixedly adhered to the inner surface 1a of a tubular film structure 1 made of a moisture permeable film 2 in such a manner that the ribs are extended in parallel with the longitudinal axis of the tubular film structure, and the tubular film structures 1 and spacer boards 4 adapted to form spaces outside the tubular film structures into which air is supplied, are alternately laid one on another. Whereby, it is provided a humidifier which is excellent in water supply characteristic, high in humidification, and low in air resistance.

7 Claims, 10 Drawing Sheets

HUMIDIFIER

BACKGROUND OF THE INVENTION

1. Field of the Invention

This invention relates to a humidifier for supplying moisture to increase the humidity of the air in a room or the like.

2. Description of the Prior Art

For energy saving, the recent living space has been improved in heat insulation and in air tightness, and there has been a strong demand for air-conditioning such living spaces to a higher degree. An air-conditioning operation includes temperature control, humidity control, and harmful air component control. For the temperature control, a variety of heating or cooling systems satisfactory in performance have been put in practical use; however, for the humidity control and the harmful air component control, no acceptable means have been proposed yet.

As for humidity control, there are available a natural evaporation type humidifier, an electrically heating type humidifier, a water spray type humidifier, and an ultrasonic humidifier. However, the natural evaporation type humidifier is disadvantageous in that it is small in humidifying capacity. The electrically heating type humidifier is high in running cost. The water spray type humidifier is low in humidifying efficiency, and is unavoidably bulky. The ultrasonic humidifier suffers from difficulties that it is high in initial cost, and short in service life, and it is liable to scatter various bacteria and fine particles of calcium carbonate contained in the water.

In view of the foregoing, the present application has conducted intensive research on the natural evaporation type humidifier which is smaller in initial cost and in running cost than the others, and is higher in safety being less scattering various bacteria or fine particles of calcium carbonate, to increase the humidifying capacity in which it was disadvantageous.

It is essential for the natural evaporation type humidifier to have a large area for water evaporation. Therefore, one example of the natural evaporation type humidifier employs a vat-shaped container having a large opening, and another example is so designed that water is supplied to a board or cloth of a hydrophilic material so that it is brought into contact with the air by capillarity. In those humidifiers, water is brought directly into contact with air, and therefore various bacteria and fine particles of calcium carbonate contained in the water are scattered to some extent. In addition, those humidifiers are insufficient in humidifying capacity.

In order to eliminate the above-described difficulties, the applicant has conducted research on a method of increasing the water evaporating area in the humidifier, and proposed the following humidifier: As shown in FIG. 17, a humidifying tubular film structure 1 is made of a waterproof and moisture-permeable film 1, and, in order to allow water to smoothly flow into the tubular film structure 1 thus formed, a spacer 7 is inserted into the latter 1 in such a manner that flat chambers several milli-meters in height are formed in it. The flat chambers are filled with water, and steam passed through the waterproof and moisture-permeable film 2 of the tubular film structure 1 is contained in the air supplied to the outer surface of the latter 1, to increase the humidity of the air. More specifically, a humidifier having a humidifier body 8 as shown in FIG. 18 has been proposed. The humidifier body 8 is formed as follows: That is, a corrugated spacer board 4 of synthetic resin or the like adapted to form spaces into which air is supplied is laid over the above-described tubular film structure 1, and the spacer board 4 and the tubular film structure 1 are spirally wound. In the humidifier, the water evaporating area is markedly increased, various bacteria and fine particles of calcium carbonate are scarcely scattered. Those facts have been disclosed by Unexamined Japanese Patent Applications (Kokai) Sho-60-171337/(1985), Sho-61-175421/ (1986), Sho-61-237942/(1986), and Sho-61-250429/(1986).

In the above-described conventional humidifier, as shown in FIG. 17 the humidifying tubular film structure 1 and the spacer 7 are formed separately. Hence, when water is supplied to the humidifier body 8 for humidification which has been formed by spirally winding the spacer board 4 and the tubular film structure 1 with the spacer 7, the humidifier suffers from the following difficulties: As shown in FIG. 19, the tubular film structure 1 is inflated by water pressure, so that it is partially brought into close contact with the spacer board 4 which is not gas-permeable, so that the air contact area of the waterproof and moisture-permeable film 2 is decreased as much; that is, the amount of humidification is decreased. Furthermore, the air passage area is decreased as much as the tubular film structure 1 is inflated, and the resistance against the air supplied to the humidifier body 8 is therefore increased. FIG. 20 is a graphical representation indicating water supply time, air resistance, and humidifying capacity with respect to water supply pressure in the humidifier. When, in order to prevent the inflation of the tubular film structure 1, the pressure of the water supplied to the latter 1 is decreased, the water supplying capacity for the tubular film structure 1 is decreased, as a result of which it becomes difficult to supply water to the whole tubular film structure, and the humidifying capacity is therefore decreased. That is, contradictorily, the prevention of the inflation of the tubular film structure results in the decrease of the humidifying capacity. Thus, there has been a strong demand for a drastic solution of the above-described problems.

SUMMARY OF THE INVENTION

An object of this invention is to eliminate the above-described difficulties accompanying a conventional humidifier. More specifically, an object of the invention is to provide a humidifier which is high in water supplying capacity and in humidifying performance, and is less resistive against air supplied to the humidifier body.

In a humidifier according to the invention, a plurality of ribs made of a flexible material are fixedly adhered to the inner surface of a tubular film structure made of a moisture permeable material in such a manner that the ribs are extended in parallel with the longitudinal axis of the tubular film structure, and the tubular film structures and spacer boards adapted to define spaces outside the tubular film structure into which air is supplied, are alternately laid one on another.

In another humidifier of the invention, a plurality of ribs made of a flexible material are fixedly adhered to a substantially half of the inner surface of the tubular film structure, and the tubular film structure together with the spacer board is spirally wound with the ribs set closer to the center of the spiral.

Alternatively, the spacer board is fixedly adhered to a part of the outer surface of the tubular film structure to the inner surface of which part the ribs have been fixedly adhered.

In the humidifier of the invention, with the aid of the plurality of flexible ribs fixedly adhered to the tubular film structure in such a manner that they are extended in parallel with the longitudinal axis of the latter, a tension acts on the tubular film structure in the longitudinal direction, which prevents the tubular film structure from being inflated when water is supplied to thereto. Hence, the area of the tubular film structure which is in contact with the spacer board is prevented from being increased, and the air contact area of the moisture permeable film is maintained wide.

In the humidifier in which the tubular film structure and the spacer board are spirally wound, the ribs adhered fixedly to the inner surface of the tubular film structure which is closer to the center of the spiral act to stiffen the side of the tubular film structure greatly which is closer to the center of the spiral, thus positively preventing the inflation of the tubular film structure.

Furthermore, with the aid of the spacer board adhered fixedly to the part of the outer surface of the tubular film structure to the inner surface of which the ribs have been fixedly adhered, great tension acts on the tubular film structure in the longitudinal direction from both the inner and outer surfaces, thus positively preventing the inflation of the tubular film structure.

DETAILED DESCRIPTION OF PREFERRED EMBODIMENTS

First Embodiment

A first embodiment of this invention will be described with reference to FIGS. 1 through 7.

Figure 1:
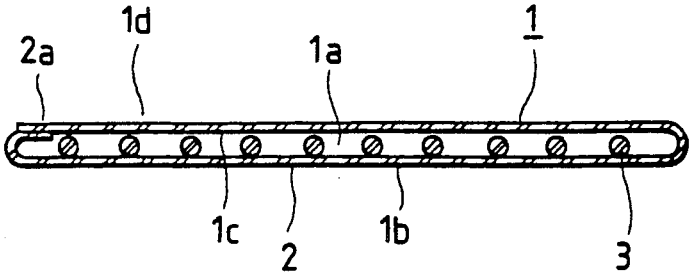
FIG. 1 is a sectional view showing a tubular film structure in a humidifier body in a humidifier, which constitutes a first embodiment of this invention.

FIG. 1 is a sectional view showing a tubular film structure. In FIG. 1, reference numeral 1 designates the tubular film structure. The tubular film structure 1 is formed as follows: First, a plurality of ribs 3 made of a flexible material are fixedly adhered to substantially a half of one side of a belt-shaped, porous, waterproof and moisture-permeable film 2 in such a manner that they are extended in parallel with the longitudinal axis of the film 2. Under this condition, two ends 2*a* (extended in the direction of the longitudinal axis) of the film 2 are adhered to each other, to form a tube. A water supplying inlet is provided at one end of the tube thus formed, and the other end of the tube is closed. Thus, the tubular film structure 1 has been formed.

Figure 2:
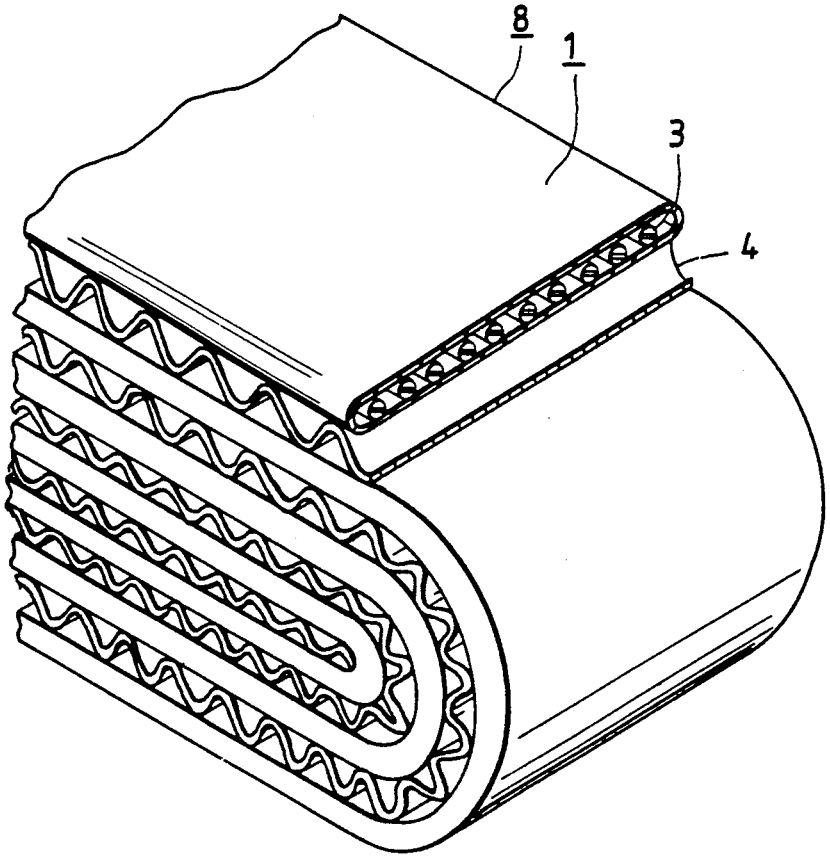
FIG. 2 is a perspective view, with parts cut away, showing the humidifier body in the first embodiment.

FIG. 2 is a perspective view showing a humidifier body 8 with the tubular film structure 1 (FIG. 1) thus formed. A corrugated spacer board 4 adapted to form spaces on the outer surfaces of the tubular film structure into which air is supplied is placed on the rib adhesion side outer surface 1*b* of the tubular film structure 1. Under this condition, the spacer board 4 and the tubular film structure 1 are spirally wound with the rib adhesion side outer surface 1*b* set inside (closer to the center of the spiral).

In a concrete example of the humidifier body, the porous, waterproof and moisture-permeable film 2 was a compound member which was formed by adhering a piece of reinforcing gas-permeable woven cloth to a porous polytetrafluoroethylene sheet ("Microtex" manufactured by the Nitto Denko Corporation). As shown in FIG. 1, ten vinyl chloride ribs 2 mm in diameter were adhered on a half of one side of a porous polytetrafluoroethylene sheet 20 cm in width and 10 m in length at intervals of about 10 mm by using a polyurethane adhesive agent. Thereafter, the sheet with the ribs was doubled, and the two ends 2a were bonded to each other, to form a tube 10 m in length. A water supply inlet was formed at one end of the tube, and the other end of the tube was closed, to form the tubular film structure. Thereafter, as shown in FIG. 2, the corrugated spacer board 4 was placed on the rib adhesion side outer surface 1b of the tubular film structure, and the spacer board 4 and the tubular film structure were spirally wound with the rib adhesion side outer surface set inside (closer to the center of the spiral).

Figure 4:
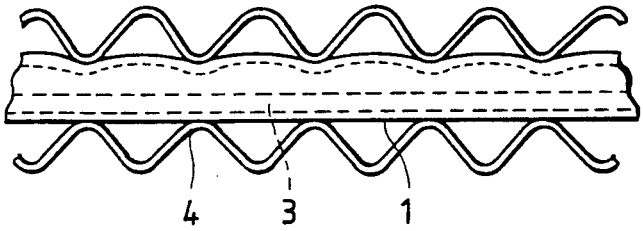
FIG. 4 is a side view of a part of the tubular film structure, showing how the latter is deformed when water is supplied to the humidifier body in the first embodiment.

The moisture-permeable film type humidifier body 8 thus formed was connected through a water supply pipe 9 to a water supply tank 5. In the case of a water supply pressure of 0.05 kg/cm$^2$, a tensile force acts on the tubular film structure 1 in the longitudinal direction with the aid of the ribs 3 fixedly adhered to the latter 1, while a tensile force was naturally applied to the rib non-adhesion side outer surface 1d when compared with the rib adhesion side outer surface 1b because the rib non-adhesion side outer surface was farther from the center of the spiral. Hence, the humidifier body 8 was free from the difficulty that, as shown in FIG. 4, the rib adhesion side outer surface 1b was brought into close contact with the corrugated spacer board 4 being inflated. That is, in the humidifier body 8, the air contact area of the porous, waterproof and moisture-permeable film 2 was sufficiently large, and the amount of humidification was 130 to 150% of that of the conventional moisture-permeable film type humidifier body. In addition, since the spaces held by the spacer board 4 were large, the resistance against the air supplied to the humidifier body was about 50% of that in the case of the conventional moisture permeable film type humidifier body.

Figure 3:
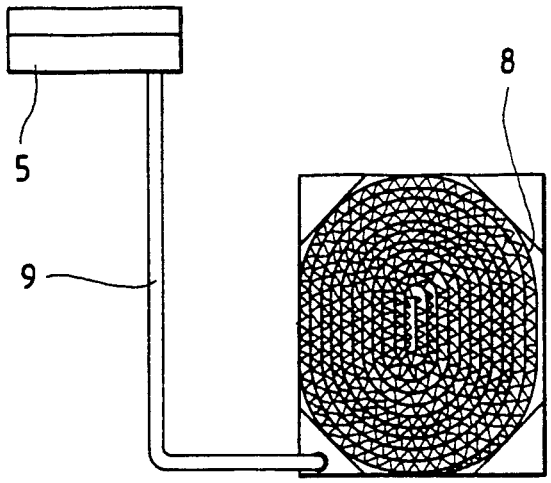
FIG. 3 is an explanatory diagram showing the connection of a water supply tank and the humidifier body in the first embodiment.
Figure 5:
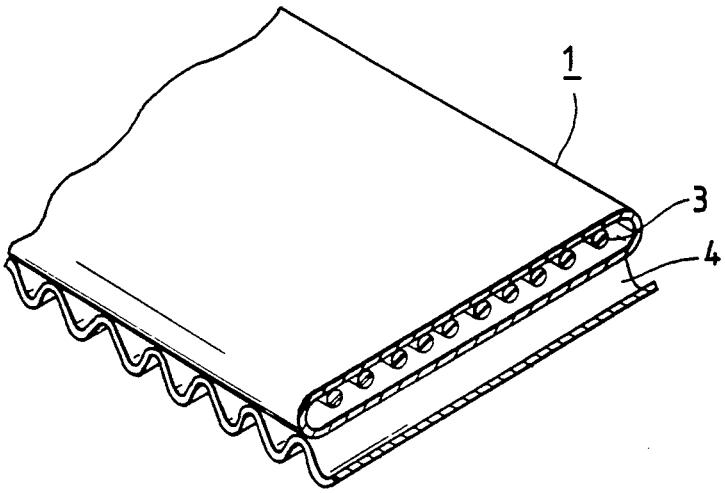
FIG. 5 is a perspective view, with parts sectioned, showing the tubular film structure of the humidifier body in the first embodiment.
Figure 6:
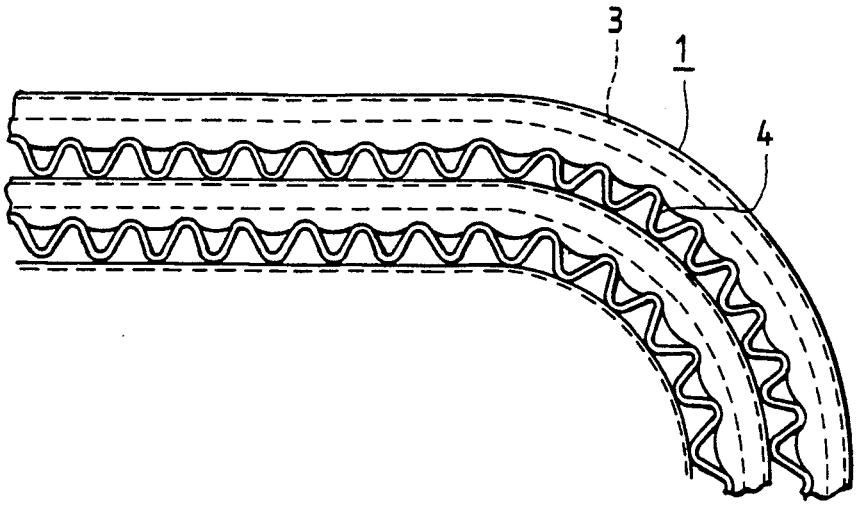
FIG. 6 is a sectional view showing a part of the humidifier body in the first embodiment.
Figure 7:
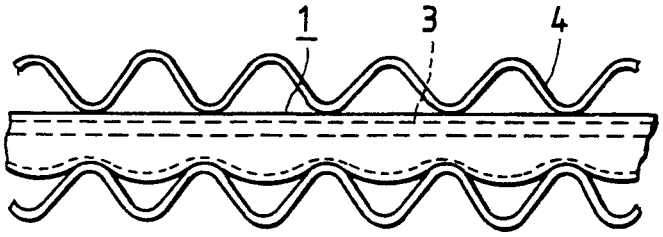
FIG. 7 is a side view of a part of the tubular film structure, showing how the latter is deformed when water is supplied to the humidifier body in the first embodiment.

Another example of the moisture permeable film type humidifier body 8 was formed as follows: The corrugated spacer board 4 was placed on the rib non-adhesion side outer surface 1d of the tubular film structure 1 as shown in FIG. 5, and the spacer board 4 and the tubular film structure 1 were wound spirally with the outer surface 1d set inside (closer to the center of the spiral) as shown in FIG. 6. The humidifier body 8 thus formed was connected through the water supply pipe 9 to the water supply tank 5 as shown in FIG. 3. In this case, as shown in FIG. 7, the rib non-adhesion side outer surface of the tubular film structure 1 was somewhat brought into close contact with the spacer board 4; however, the tensile strength of the ribs 3 acted on the tubular film structure on the rib adhesion side, so that the humidifying performance was 115 to 130% of that of the conventional moisture permeable film type humidifier body. However, during the water supplying operation, the resistance against the air supplied to the humidifier was about 70% of that in the case of the conventional moisture permeable film type humidifier. This means that the tubular film structure and the spacer board should be wound with the rib adhesion side spiral).

Second Embodiment

Figure 8:
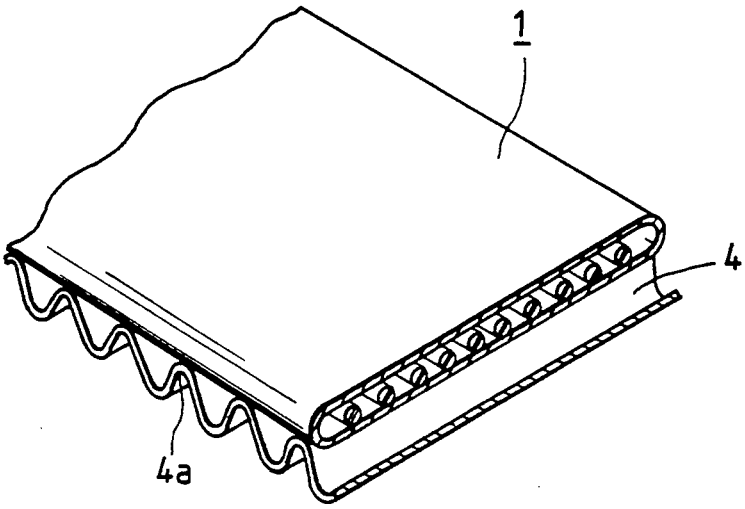
FIG. 8 is a perspective view, with parts cut away, showing a tubular film structure and a spacer board in one example of a humidifier body in a humidifying system, which constitutes a second embodiment of the invention.

FIG. 8 is a perspective view showing the spacer board 4 which is placed on the outer surface 1b rib adhesion side of the tubular film structure 1, and then fixedly adhered to the latter 1b. In FIG. 8, reference character 4a designates adhering surfaces between the tubular film structure 4 and the spacer board 4. The tubular film structure 1 and the spacer board 4 are spirally wound with the rib adhesion side outer surface 1b set inside (closer to the center of the spiral), thus forming a moisture permeable film type humidifier body 8. The other arrangements are the same as those of the above-described first embodiment.

The moisture permeable film type humidifier body 8 was connected through the water supply pipe 9 to the water supply tank 5 as shown in FIG. 3. In the case where a water supply pressure was 0.05 kg/cm$^2$, strong tensile forces were applied to the tubular film structure in the longitudinal direction from both sides; i.e., from the inner and outer surfaces thereof with the aid of the ribs 3 and the spacer board 4 which were fixedly adhered to the tubular film structure 1. Hence, the humidifier body 8 was free from the difficulty that the rib adhesion side outer surface 1b of the tubular film structure 1 was brought into close contact with the corrugated spacer board 4 while the tubular film structure 1 being inflated. That is, in the humidifier body 8, the air contact area of the porous, waterproof and moisture-permeable film 2 was sufficiently large, and the amount of humidification was 130 to 150% of that of the conventional moisture-permeable film type humidifier body. In addition, since the spaces held by the spacer board 4 were large, the resistance against the air supplied to the humidifier was about 50% of that in the case of the conventional moisture permeable film type humidifier.

Figure 9:
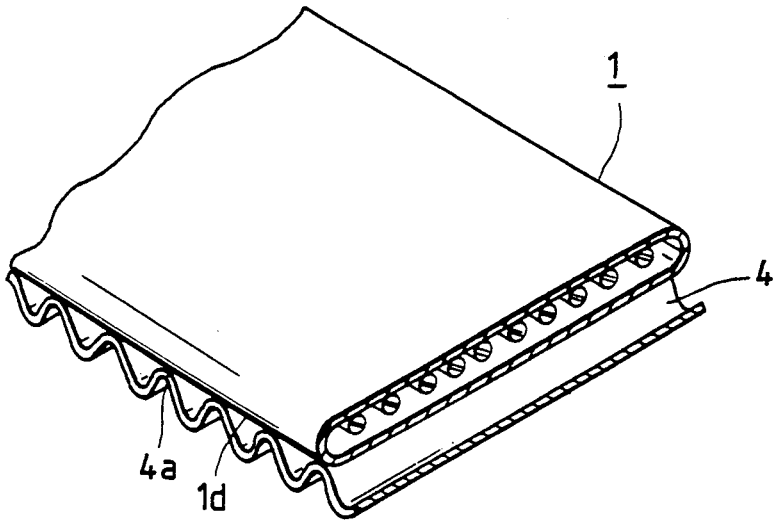
FIG. 9 is a perspective view, with parts cut away, showing a tubular film structure and a spacer board in another example of the humidifier body in the second embodiment of the invention.

As shown in FIG. 9, the spacer board 4 was fixedly adhered to the rib non-adhesion side outer surface 1d of the tubular film structure 1. Under this condition, the spacer board and the tubular film structure were spirally wound. However, the resultant humidifier was unacceptable, because the outer surfaces of the tubular film structure were wrinkled both in the case where the spacer 4 was set inside and in the case where it was set outside. Hence, in order to improve the humidifying performance, the corrugated spacer board 4 should be fixedly adhered to the rib adhesion side outer surface 1b, and the spacer board 4 and the tubular film structure 1 should be wound with the rib adhesion side outer surface 1b set inside (closer to the center of the spiral).

Third Embodiment

Figure 10:
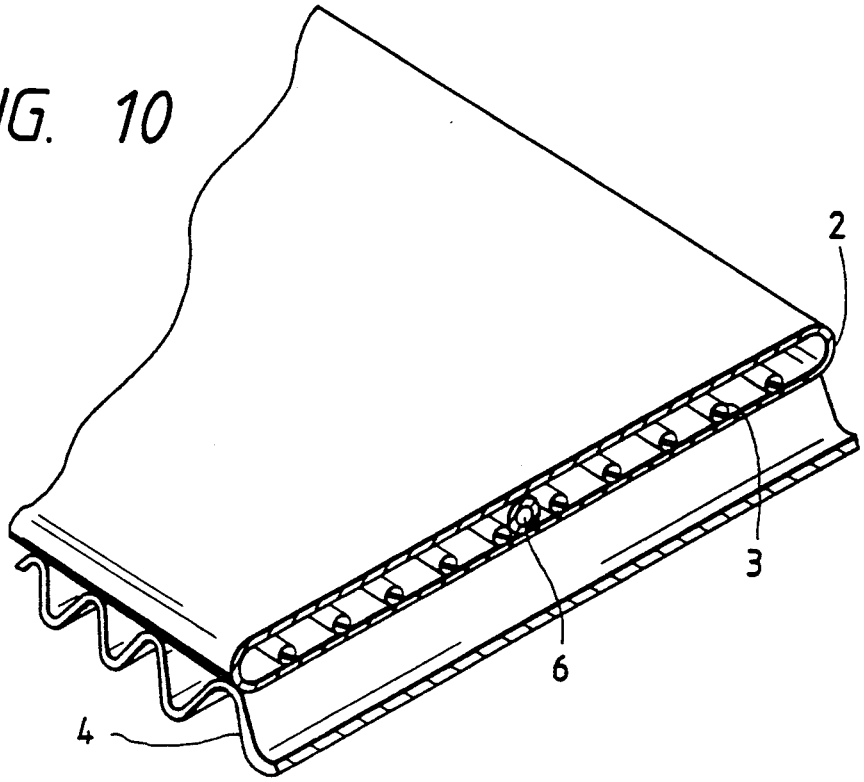
FIG. 10 is a perspective view, with parts cut away, showing a tubular film structure and a spacer board in a humidifier body in a humidifier, which constitutes a third embodiment of the invention.

A third embodiment of the invention is as shown in FIG. 10. In the third embodiment, its tubular film structure is formed by using a non-porous moisture permeable film material which is a compound material (Second-generation Gore-Tex manufactured by Japan Gore-Tex Co.) which is formed by coating one surface of a porous polytetra-fluoroethylene sheet with hydrophilic polyurethane, and adhering a reinforcing cloth material high in gas permeability on the other surface of the sheet. Ten vinyl chloride ribs 2 mm in diameter are fixedly adhered to a half of the hydrophilic polyurethane coated surface of the compound material 20 cm in width and 10 m in length at intervals of about 10 mm by using a polyurethane adhesive agent. Thereafter, the sheet with the ribs is doubled, and the two ends thereof are bonded to each other, to form a tube 10 m in length. Thereafter, a pipe-shaped porous hollow member 6, 10 m in length and 5 mm in diameter, which inhibits the passage of water and permits the passage of air is inserted into the tube thus formed. A water supply inlet is provided at one end of the tube, and the other end of the tube is closed, to form the tubular film structure. Thereafter, as shown in FIG. 2, the corrugated-plate-shaped spacer board 4 is placed on the rib adhesion side outer surface 1*b* of the tubular film structure, and the spacer board 4 and the tubular film structure are spirally wound with the rib adhesion side outer surface set inside (closer to the center of the spiral).

In the case of that the non-porous moisture permeable film material is used to form the tubular film structure, it is difficult to supply the water into the tubular film structure, because the air in the tubular film structure can not be exhausted (the air can not penetrate the non-porous moisture permeable film). In order to supply the water into the tubular, the pipe-shaped porous hollow member 6 which inhibits the passage of water and permits the passage of air is inserted into the tube. Thereby, when the water is supplied to the tube, the air is exhausted from the tube, and the water can be supplied into the tube.

The moisture-permeable film type humidifier 8 thus formed was connected through a water supply pipe 9 to a water supply tank 5. With a water supply pressure of 0.05 kg/cm$^2$, a tensile force was applied to the tubular film structure 1 the latter 1, while a tensile force was naturally applied to the rib non-adhesion side outer surface 1*d* when compared with the rib adhesion side outer surface 1*b* because the rib non-adhesion side outer surface was farther from the center of the spiral. Hence, the humidifier body 8 was free from the difficulty that the rib adhesion side outer surface 1*b* was brought into close contact with the corrugated spacer board being inflated. That is, since the air contact area of the non-porous moisture-permeable film 2 was large, the amount of humidification was 130 to 150% of that in the conventional moisture permeable film type humidifier. In addition, since the spaces held by the spacer board 4 were large, the resistance against the air supplied to the humidifier was about 50% of that in the case of the conventional moisture permeable film type humidifier.

Furthermore, as was described above, in the third embodiment, the non-porous moisture-permeable film is employed as the moisture-permeable film material. This is advantageous in that, even when surface active agent is mixed with the water, no water infusion occurs with the humidifier body.

On the other hand, the corrugated spacer board 4 was placed on the rib non-adhesion side outer surface 1*d* of the tubular film structure 1, and the spacer board 4 and the tubular film structure 1 were wound spirally with the outer surface 1*d* set inside (closer to the center of the spiral). In this case, the rib non-adhesion side outer surface 1*d* of the tubular film structure 1 was somewhat brought into close contact with the spacer board 4; however, the tensile strength of the ribs 3 acted on the tubular film structure on the rib adhesion side, so that the humidifying performance was 115 to 130% of that of the conventional moisture permeable film type humidifier. However, during the water supplying operation, the resistance against the air supplied to the humidifier was about 70% of that in the case of the conventional moisture permeable film type humidifier. This means that the tubular film structure and the spacer board should be wound with the rib adhesion side outer surface 1*b* set inside (closer to the center of the spiral).

Fourth Embodiment

Figure 11:
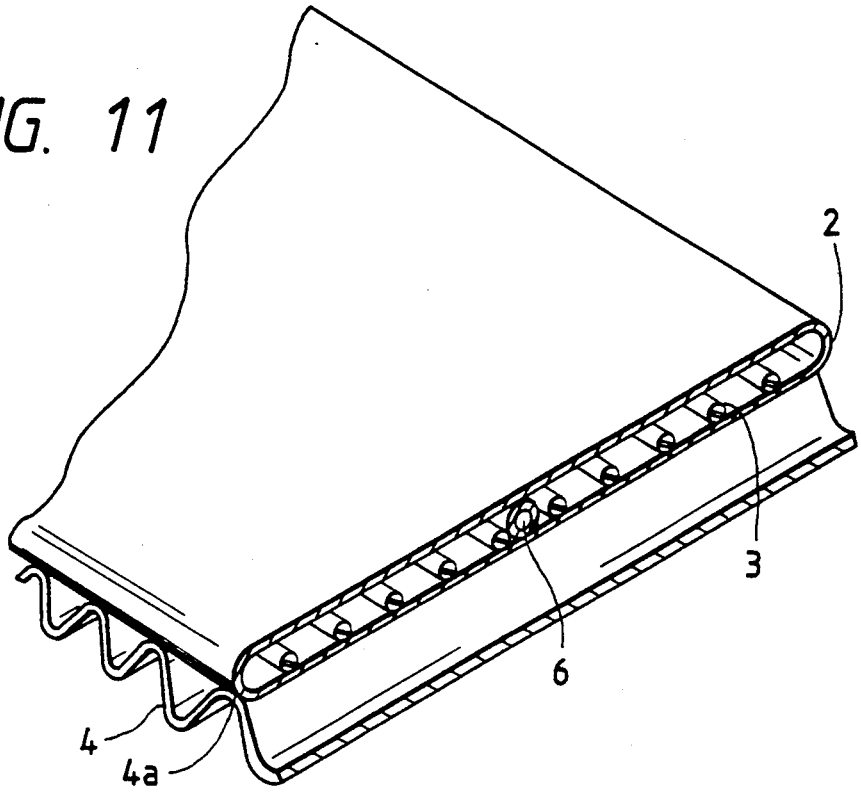
FIG. 11 is a perspective view, with parts cut away, showing a tubular film structure and a spacer board in a humidifier body in a humidifier, which constitutes a fourth embodiment of the invention.

FIG. 11 is a perspective view showing the spacer board 4 which is fixedly adhered onto the rib adhesion side outer surface 1*b* of the tubular film structure 1 of the third embodiment. In FIG. 11, reference character 4*a* designates adhering surfaces between the tubular film structure 4 and the spacer board 4. The tubular film structure 1 and the spacer board 4 are spirally wound with the rib adhesion side outer surface 1*b* set inside (closer to the center of the spiral) as shown in FIG. 2, thus forming a moisture permeable film type humidifier body 8. The other arrangements are the same as those of the above-described third embodiment.

The moisture permeable film type humidifier body 8 thus formed was connected through the water supply pipe 9 to the water supply tank 5 as shown in FIG. 3. With a water supply pressure of 0.05 kg/cm$^2$, strong tensile forces were longitudinally applied to the tubular film structure from both sides; i.e., from the inner and outer surfaces thereof with the aid of the ribs 3 and the spacer board 4 which were fixedly adhered to the tubular film structure 1. Hence, in the humidifier body 8, the rib adhesion side outer surface 1*b* of the tubular film structure 1 was more effectively prevented from being brought into close contact with the corrugated spacer board 4. And the amount of humidification was 130 to 150% of that of the conventional moisture-permeable film type humidifier. In addition, since the spaces held by the spacer board 4 were large, the resistance against the air supplied to the humidifier was about 50% of that in the case of the conventional moisture permeable film type humidifier.

In addition, even when surface active agent was added to the water, no water infusion occurred with the humidifier at all.

The spacer board 4 was fixedly adhered to the rib non-adhesion side outer surface 1*d* of the tubular film structure 1. Under this condition, the spacer board and the tubular film structure were spirally wound. However, the resultant humidifier was unacceptable, because the outer surfaces of the tubular film structure were wrinkled both in the case where the spacer board 4 was set inside and in the case where it was set outside. Hence, in order to improve the humidifying performance, the corrugated spacer board 4 should be fixedly adhered to the rib adhesion side outer surface 1*b*, and the spacer board 4 and the tubular film structure 1 should be wound with the rib adhesion side outer surface 1*b* set inside (closer to the center of the spiral).

Figure 12:
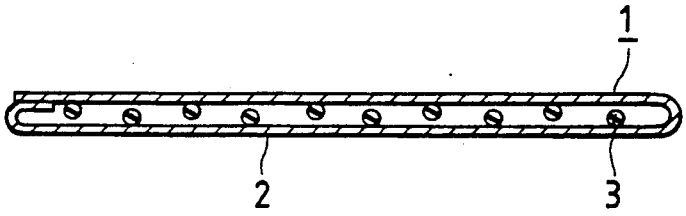
FIG. 12 is a sectional view showing one modification of the tubular film structure according to the invention.
Figure 13:
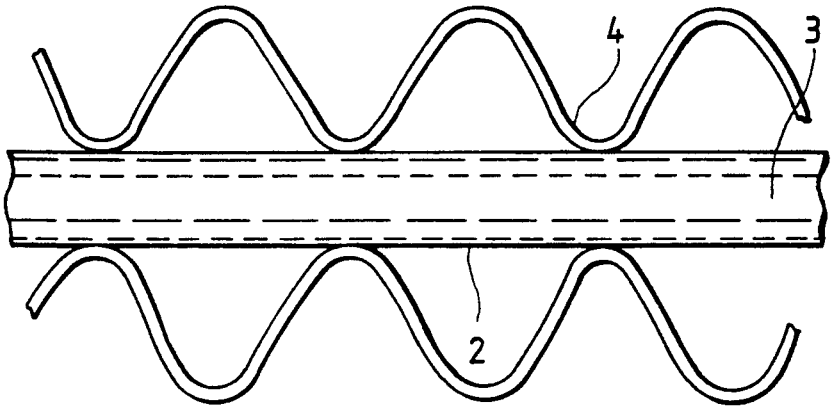
FIG. 13 is a sectional view of a part of the tubular film structure shown in FIG. 12, showing the state of the latter provided when water is supplied to the humidifier body.
Figure 14:
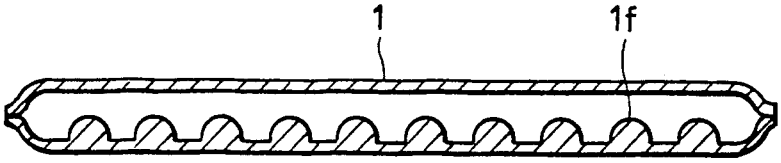
FIG. 14 is a sectional view showing another modification of the tubular film structure according to the invention.

In each of the above-described first through fourth embodiments, the ribs 3 are fixedly adhered to a half of one surface of the moisture permeable film 2 in such a manner that they are extended in the longitudinal direction of the film 2, and the two end portions 2*a* (extended in the longitudinal direction) of the latter 2 are adhered together, to form the tube; however, the invention is not limited thereto or thereby. That is, as shown in FIG. 12, the ribs 3 may be fixedly adhered to the whole inner surface of the tubular film structure 1 in such a manner that they are arranged substantially at equal intervals and in parallel with the longitudinal axis thereof. The tubular film structure thus formed is advantageous in that, as is seen from FIG. 13, its surface is positively prevented from being bent towards the center of the spiral or from being bent away from it. Furthermore, in the above-described embodiments, the vinyl chloride ribs 3 are fixedly adhered to the moisture permeable film with the polyurethane adhesive agent; however, the invention is not limited thereto or thereby. For instance, the ribs may be formed as follows: Softened polyurethane is dropped on a moisture permeable film which is being formed by extrusion molding in such a manner that it draws a plurality of lines on the moisture permeable film which are in parallel with the longitudinal axis of the film, and the plurality of lines of polyurethane are hardened. In addition, as shown in FIG. 14, the ribs 1*f* may be formed integral with the tubular film structure 1. Furthermore, as shown in FIG. 14, the tubular film structure 1 may be formed by bonding two belt-shaped moisture permeable films.

Fifth Embodiment

Figure 15:
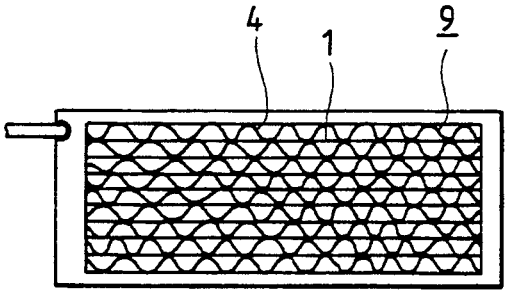
FIG. 15 is a side view showing one example of a humidifier body in a humidifier, which constitutes a fifth embodiment of the invention.
Figure 16:
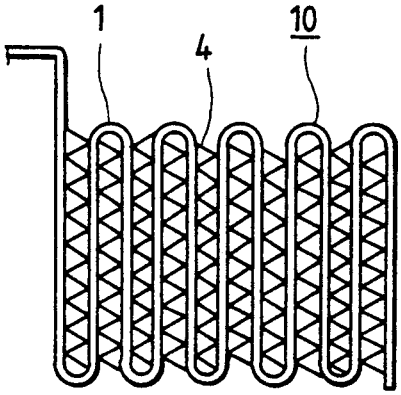
FIG. 16 is a side view showing another example of the humidifier body in the fifth embodiment.
Figure 17:
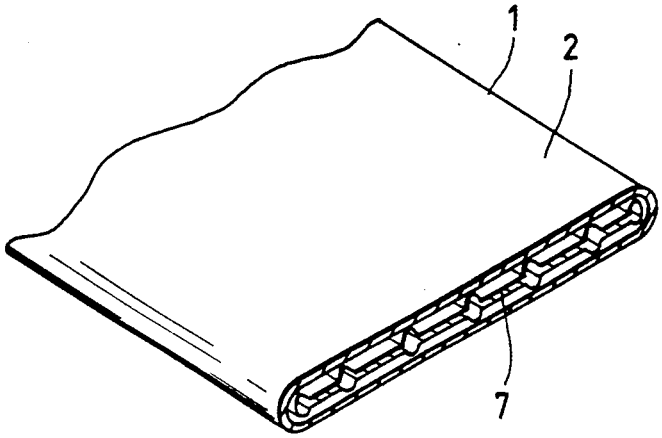
FIG. 17 is a perspective view, with part cut away, showing a tubular film structure in a conventional moisture permeable film type humidifier.
Figure 18:
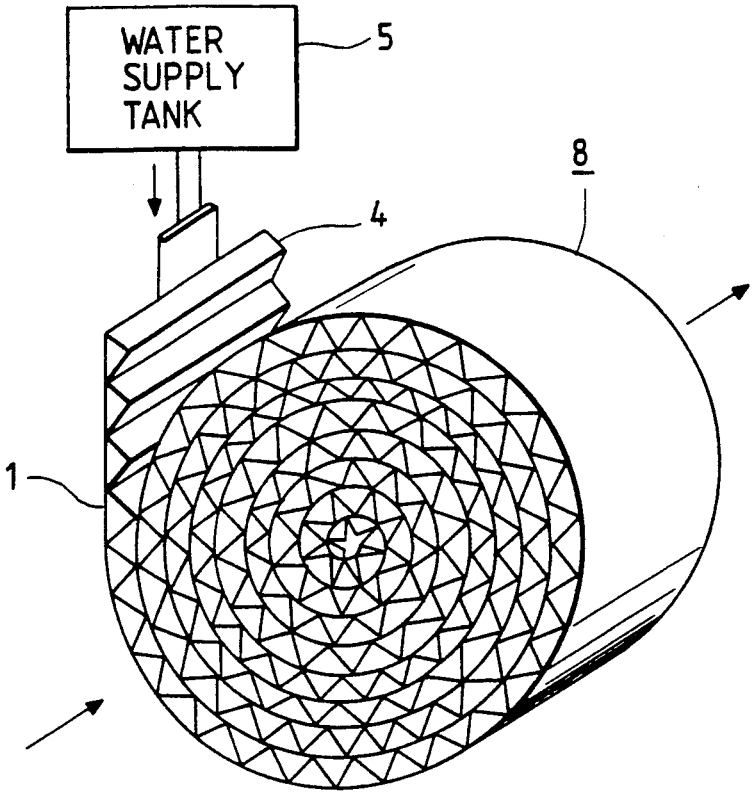
FIG. 18 is an explanatory diagram showing the connection of the conventional humidifier body and a water supply tank.
Figure 19:
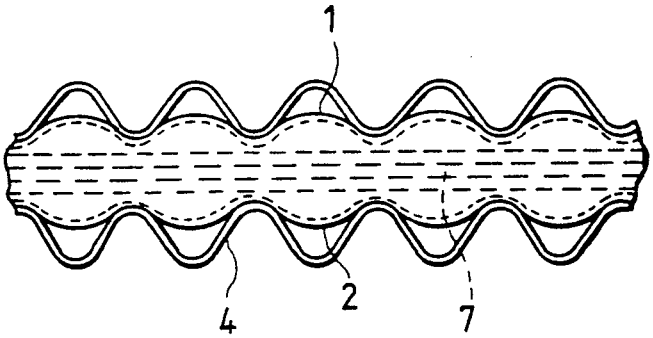
FIG. 19 is a side view showing how the tubular film structure is deformed when water is supplied to the conventional humidifier body.
Figure 20:
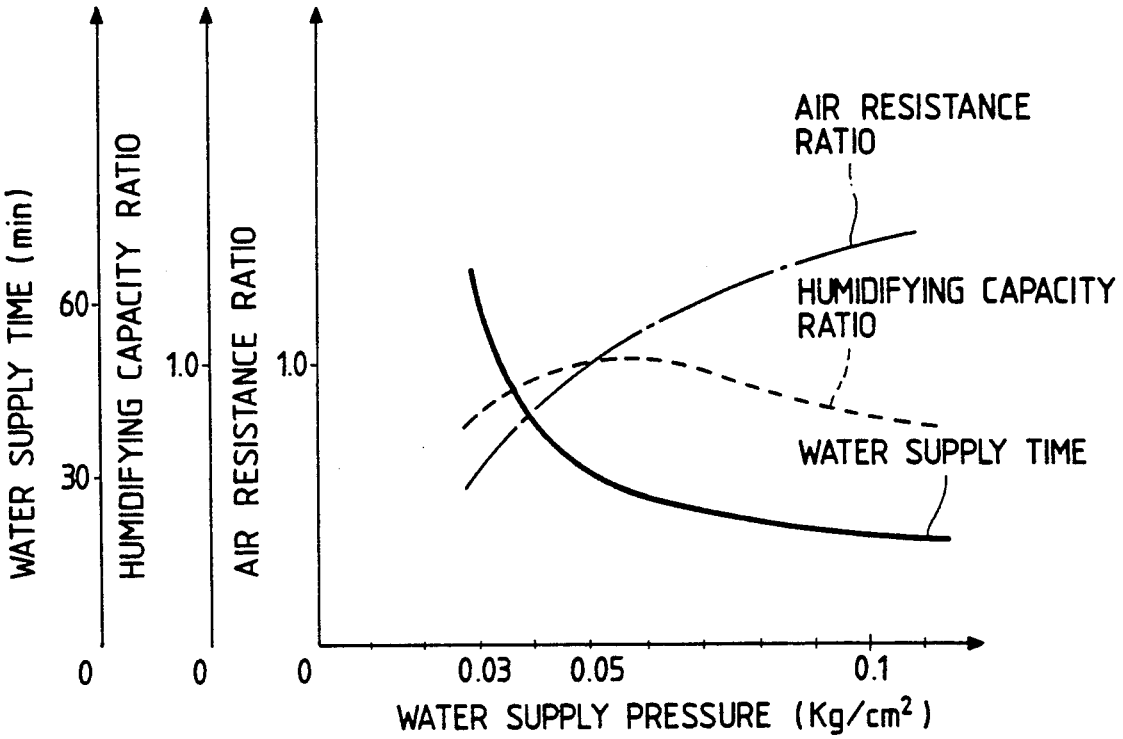
FIG. 20 is a graphical representation indicating water supply time, humidifying capacity and air resistance with respect to water supply pressure in the conventional moisture permeable film type humidifier.

FIG. 15 is a side view showing a humidifier body 9 in which the tubular film structures 1 and the spacer boards 4 are alternately laid one on another in such a manner that they are in parallel with one another. FIG. 16 is also a side view showing a humidifier body 10 in which the tubular film structure 1 is set wavy with the aid of the spacer boards 4.

In the humidifier body shown in FIG. 15, the tubular film structures 1 are held flat (being not curved). In the humidifier body shown in FIG. 16, the tubular film structure 1 is partially curved, but its larger part is flat. Therefore, in those humidifiers, a tensile force applied to each tubular film structure 1 is not uniform. Hence, in the case where the humidifier body is formed as shown in FIG. 15 or 16, the tubular film structure 1 as shown in FIG. 12 should be employed in which the ribs are fixedly adhered to the whole inner surface of the tubular film structure 1 in such a manner that they are arranged substantially at equal intervals and in parallel with the longitudinal axis thereof, because the tubular film structure is not bent over the spacer boards 4 on its both sides as shown in FIG. 13.

In each of the first through fourth embodiments of the invention, the humidifier body is formed by spirally winding the tubular film structure and the spacer board; and in the fifth embodiment, the humidifier is formed as shown in FIG. 15 or 16; however, the invention is not limited thereto or thereby. That is, other humidifier bodies different in configuration from those described above may have the same effects. It goes without saying that, in the above-described embodiments, the spacer board 4 is in the form of a corrugated plate; however, the invention is not limited thereto or thereby. That is, any spacer board can be employed which allows the air supplied to the humidifier to contain steam passed through the moisture permeable film.

As was described above, in one embodiment of the invention, a plurality of ribs are fixedly adhered to the inner surface of the tubular film structure in such a manner that the ribs are extended in parallel with the longitudinal axis of the tubular film structure, and the tubular film structures and the spacer boards are alternately laid one on another. Hence, the humidifier is free from the difficulty that, when water is supplied to the humidifier body, the surface of the moisture permeable film is inflated. Thus, in the humidifier of the invention, the large area of the moisture permeable film is brought into contact with the air supplied to the humidifier, so that the amount of humidification is greatly increased, and the resistance against the air supplied to the humidifier body is greatly reduced.

In another embodiment of the invention, the tubular film structure and the spacer board are spirally wound, with the ribs adhered to the inner surface of the tubular film structure which is closer to the center of the spiral. In another embodiment of the invention, the tubular film structure is spirally wound together with the spacer board which is fixedly adhered to the outer surface of the tubular film structure which is closer to the center of the spiral. Hence, the moisture permeable film is more positively prevented from being inflated when water is supplied to the humidifier body. Accordingly, the moisture permeable film is widely brought into contact with the air supplied to the humidifier, so that the amount of humidification is greatly increased, and the resistance against the air supplied to the humidifier body is greatly reduced.

What is claimed is:

1. A humidifier comprising:

a tubular film structure made of a moisture permeable film for supplying water thereinto so that air supplied to the outer surface of said tubular film structure is allowed to contain steam passed through said moisture permeable film;

a plurality of ribs made of a flexible material which is fixedly adhered to an inner surface of said tubular film structure in such a manner that said ribs are extended in parallel with a longitudinal axis of said tubular film structure; and a plurality of spacer boards for defining spaces outside said tubular film structure into which air is supplied;

wherein said tubular film structures and said spacer boards are alternately laid One On another.

2. A humidifier as claimed in claim 1 wherein said ribs are formed integral with said tubular film structure.

3. A humidifier comprising:

a tubular film structure made of a moisture permeable film for supplying water thereinto so that air supplied to the outer surface of said tubular film structure is allowed to contain steam passed through said moisture permeable film;

a plurality of ribs made of a flexible material which is fixedly adhered to substantially half of an inner surface of said tubular film structure in such a manner that said ribs are extended in parallel with a longitudinal axis of said tubular film structure; and a plurality of spacer boards for defining spaces outside said tubular film structure into which air is supplied, said spacer boards being placed on an outer surface of said tubular film structure;

wherein said tubular film structures and said spacer boards are alternately laid one on another, and spirally wound with said ribs set closer to the center of the spiral.

4. A humidifier as claimed in claim 3, wherein said spacer board is fixedly adhered to a part of the outer surface of said tubular film structure to the inner surface of which part said ribs have been fixedly adhered.

5. A humidifier as claimed in claim 3, wherein said moisture permeable film is a non-porous moisture permeable film material, and said humidifier further comprising a pipe-shaped porous hollow member which inhibits passage of water and permits passage of air, said hollow member being inserted into said tubular film structure.

6. A humidifier as claimed in claim 3, wherein said ribs are fixedly adhered to whole inner surface of the tubular film structure in such a manner that they are arranged substantially at equal intervals and in parallel with the longitudinal axis thereof.

7. A humidifier as claimed in claim 3 wherein said ribs are formed integral with said tubular film structure.

* * * * *